United States Patent [19]

Genba

[11] Patent Number: 4,760,224

[45] Date of Patent: Jul. 26, 1988

[54] AIR CIRCUIT INTERRUPTER

[75] Inventor: Yasusi Genba, Fukuyama, Japan

[73] Assignee: Mitsubishi Denki Kabushiki Kaisha, Japan

[21] Appl. No.: 843,752

[22] Filed: Mar. 25, 1986

[30] Foreign Application Priority Data

Mar. 28, 1985 [JP] Japan ..... 60-67528

[51] Int. Cl.[4] ..... H01H 3/46

[52] U.S. Cl. ..... 200/153 SC; 200/325

[58] Field of Search ..... 200/153 SC, 318, 320–325, 200/327; 335/10, 21–23, 46, 169–171; 74/2

[56] References Cited

U.S. PATENT DOCUMENTS

| | | | |
|---|---|---|---|
| 1,508,148 | 9/1924 | Aalborg | 200/324 |
| 1,624,372 | 4/1927 | Stoeltzlen | 200/325 |
| 1,633,979 | 6/1927 | Crabbs | 200/325 |
| 4,468,533 | 8/1984 | Kodera et al. | 200/153 SC |

FOREIGN PATENT DOCUMENTS

| | | | |
|---|---|---|---|
| 1064120 | 4/1967 | United Kingdom | 200/318 |

*Primary Examiner*—Henry J. Recla
*Assistant Examiner*—Linda J. Sholl
*Attorney, Agent, or Firm*—Leydig, Voit & Mayer

[57] ABSTRACT

An air circuit interrupter which comprises a first cam driven by the operating handle which, through a charge lever, charges an energy storing spring, a link mechanism for transmitting the stored spring force to a contact operating mechanism, a contact-opening-waiting mechanism for preventing the link mechanism from driving the contact operating mechanism to open when the contact is closed by an action of a spring force of a contacting pressure spring in the contact operating mechanism and an electromagnetic repulsive force acting on a current carrying member due to a current above a predetermined value, and an OFF operating member for opening the contact by releasing the contact-opening-waiting state of the contact-opening-waiting mechanism. The contact-opening-waiting mechanism comprises a second cam connected to the link mechanism and a trip latch having an engaging roller for engaging the second cam and an engaging portion for engaging the OFF operating member. The trip latch is constituted by a roller side latch half member having the engaging roller and an engaging side latch half member having the engaging portion, the half members being pivotally mounted on a common shaft. An elastic member is inserted between the half members so that they are biased away from each other, and the half members of the trip latch are displaced toward each other against the elastic member by the action to release the contact-opening-waiting state to open the contact.

6 Claims, 6 Drawing Sheets

AIR CIRCUIT INTERRUPTER

BACKGROUND OF THE INVENTION

This invention relates to an air circuit interrupter and more particularly to an air circuit interrupter in which, after the energy storing spring is charged by the operation of the circuit interrupter handle, the current carrying portion is closed and opened at command by the charged spring force. Generally, this kind of circuit interrupter is used for a main electrical circuit for low voltage distribution and, perferably, has a large interrupting capacity and is as compact as possible.

FIGS. 1 to 3 show a conventional air circuit interrupter as disclosed in Japanese Patent Laid Open No. 58-129720 for example, in which 1 is an operating handle pivotably supported by a shaft 2, 3 is a first cam driven by the operating handle 1 for rotation, 4 is a charge lever engaging with the operating lever 1 and driven to rotate, 5 is an energy storing spring chargeable by the charge lever 4, 6 is a link mechanism for transmitting the spring force of the energy storing spring 5 to a contact operating mechanism side and is comprised of a pair of links 6*a* and 6*b* or the like. A direction changing lever 7 is pivotably supported by a pivot shaft 7*a*, its lower end portion being connected to the link 6*a* and the upper end portion being connected to an insulating link 8 which constitutes a part of the contact operating mechanism which will be described later. A pair of conductors 9*a* and 9*b* constitute a part of the current carrying portion, 10 is a main stationary contact secured to the conductor 9*a*, 11 is a main movable contact engaging and separating relative to the stationary contact 10, 12 is a movable member on which the movable contact 11 is secured, 13 is a movable member holder for holding the movable member 12 having connected to its upper end portion the insulating link 8. A contacting pressure spring 14 biases the movable member 12 in the direction of contact closing, this contacting spring 14 constituting, together with the movable member 12, the holder 13 and the insulating link 8, the contact operating mechanism. A throw-in latch 15 is rotatably supported by a pivot shaft 16, which is rotated counterclockwise by a D-shaped latch 17 on an ON operating member side which releases the contact closing waiting state. A trip latch 18 is pivotally supported by the pivot shaft 16 and biased in the counterclockwise direction by the return spring 19, 20 is a second cam rotatably supported by a shaft 21 and biased counterclockwise by a return spring 22, which has a recessed portion 20*a* for engaging the engaging roller 18*a* on the lower end portion of the trip latch 18, so that the clockwise compressive force is applied against the trip latch 18 against the spring force of the return spring. A strut link 23 is connected between a pin 20*b* of the second cam 20 and the pin 6*c* of the link mechanism 6, 24 is a D-shaped latch which is engageable with the engaging portion 18*b* of the trip latch 18 to prevent the clockwise rotation of the trip latch 18 and which constitutes, together with the trip latch 18 and the second cam 20, a contact-opening-waiting mechanism This mechanism maintains the link mechanism 6 extended against the spring force of the contacting pressure spring 14 and the electromagnetic repulsive force acting on the current carrying member due to a current above a predetermined value. The D-shaped latch 24 is rotated clockwise by the OFF operating member (not shown) for releasing the contact-opening-waiting state.

The operation will next be explained. In the state shown in FIGS. 1 and 2, the direction changing lever 7 is biased and rotated counterclockwise by the spring force of the contacting pressure spring 14 causing the spring to extend, and the link mechanism 6 is subjected to a force which causes the mechanism 6 to be folded at the pin 6*c* in the direction of an arrow 25. However, since the second cam 20 is blocked by the trip latch 18 and is not rotated clockwise, the mechanism 6 is maintained in the illustrated state. This state is referred to as the contact-opening-waiting state. In this state, the clockwise rotational force on the second cam 20 driven by the strut link 23 against the return spring 22 is blocked by the trip latch 18 engaging the engaging portion 18*b* at the D-shaped latch 24.

As shown in FIG. 3, when the D-shaped latch 24 is rotated clockwise by the operation of the OFF operating member, since the trip latch 18 is slightly rotated clockwise against the spring force of the return spring 19, the recessed portion 20*a* disengages from the engaging roller 18*a* and the second cam 20 is rotated clockwise by the action of the contacting pressure spring 14 shown by the arrow 25 of FIG. 2. Therefore, the strut function of the link 23 is lost and the link mechanism 6 is collapsed. This movement causes the separation of the contacts 10 and 11 as shown in FIG. 3. The explanation of the operation for charging the energy storing spring 5 and the ON operation is omitted.

In this air circuit interrupter, an abnormal current in the circuit is quickly interrupted by manually rotating the D-shaped latch 24 for opening the OFF operating member side in the clockwise direction, or by detecting an abnormal current flowing in the interrupter by a current transformer (not shown) or the like to excite the electromagnetic coil (not shown) in accordance with the inverse time delay characteristics by the electric control unit of the trip relay (not shown). The rated interrupting current of the interrupter at this time means maximum current which is in accordance with the inverse time delay characteristics and which is capable of being interrupted by that interrupter without causing thermal or electromagnetic damages within the interrupting time period.

Also, in this air circuit interrupter, since the interrupting capacity is determined by designing the link mechanism 6 or the like in accordance with the rated interrupting current, the higher the rated interrupting current the bigger the dimensions of the link mechanism 6 or the like, resulting in a large frame size of the interrupter, and also with the same rated interrupting current and the frame size, the higher the interrupting capacity the shorter the interrupting time period.

The interrupting time is the time period composed of the relay time during which the current is detected and the opening D-shaped latch 24 is rotated by an electromagnetic coil or the like, the opening time from the rotation of the D-shaped latch 24 for collapsing the link mechanism 6 to the initiation of the separation of the contacts 10 and 11, and the arcing time during which the arc is generated between the contacts 10 and 11 and is extinguished.

In the above-described conventional air circuit interrupter, since the interrupting time is substantially constant, the problem arises that as the interrupting capacity increases the rated interrupting current as well as the frame size increase.

SUMMARY OF THE INVENTION

An object of the present invention is to provide an air circuit interrupter in which the above discussed problem is resolved.

Another object of the present invention is to provide an air circuit interrupter in which the interrupting capacity can be increased by shortening the interrupting time without increasing the frame size.

With the above objects in view, an air circuit interrupter which has contacts movable between open and closed positions comprises in accordance with the present invention an energy storing spring, a mechanism for charging the energy storing spring, and a contact operating mechanism which is operatively associated with the contacts and includes a contacting pressure spring. The air circuit interrupter also comprises a link the energy storing spring. The link mechanism is movable between an extended position with the contacts closed and a folded position with the contacts open. The air circuit interrupter further comprises a mechanism for releasing the link mechanism to the folded position. The releasing mechanism is responsive to a contact current which exceeds a predetermined value and includes a trip latch having first and second latch members pivotally mounted to each other and an elastic member inserted between them. The elastic member is responsive to the spring force of the contacting pressure spring and the electromagnetic repulsive force acting on the contacts.

An air circuit interrupter in accordance with the present invention may alternatively comprise a first cam driven to be rotate by the handle operation of the circuit interrupter, a charge lever in rolling contact with the first cam for rotation, an energy storing spring chargeable by the charge lever, a link mechanism for transmitting the stored spring force in the spring to the side of a contact operating mechanism, a contact-opening-waiting mechanism for preventing the link mechanism from driving the contact operating mechanism to open when the contact is closed by an action of a spring force of a contacting pressure spring in the contact operating mechanism and an electromagnetic repulsive force acting on a current carrying member due to a current above a predetermined value, and an OFF operating member for opening the contact by releasing the contact-opening-waiting state by the contact-opening-waiting mechanism, the contact-opening-waiting mechanism comprising a second cam connected to the link mechanism and a trip latch having an engaging roller for engaging the second cam and an engaging portion for engaging the OFF operating member, the trip latch comprised a roller side latch half member having the engaging roller, an engaging side latch half member having the engaging portion, the half members being pivotally mounted on a common shaft, and an elastic member inserted between the half members so that they are biased away from each other, the half members of the trip latch being displaced toward each other against the elastic member by the action to release the contact-opening-waiting state to open the contact.

According to the present invention, the contact-opening-waiting state is released when the latch halves of the trip latch are rotated toward each other against the elastic member by an action of the spring force of the contacting pressure spring and an electromagnetic repulsive force acting on the current carrying member upon the ocurrence of a current above a predetermined value, and the contact is separated before the rotation of the D-shaped latch on the OFF operating member side, so that the relay time of the interrupting time is minimized to shorten the interrupting time, resulting in a high speed interruption.

BRIEF DESCRIPTION OF THE DRAWINGS

The present invention will become more readily apparent from the following detailed description of the preferred embodiment of the present invention taken in conjunction with the accompanying drawings, in which.

DETAILED DESCRIPTION OF THE PREFERRED EMBODIMENT

Figure 1:
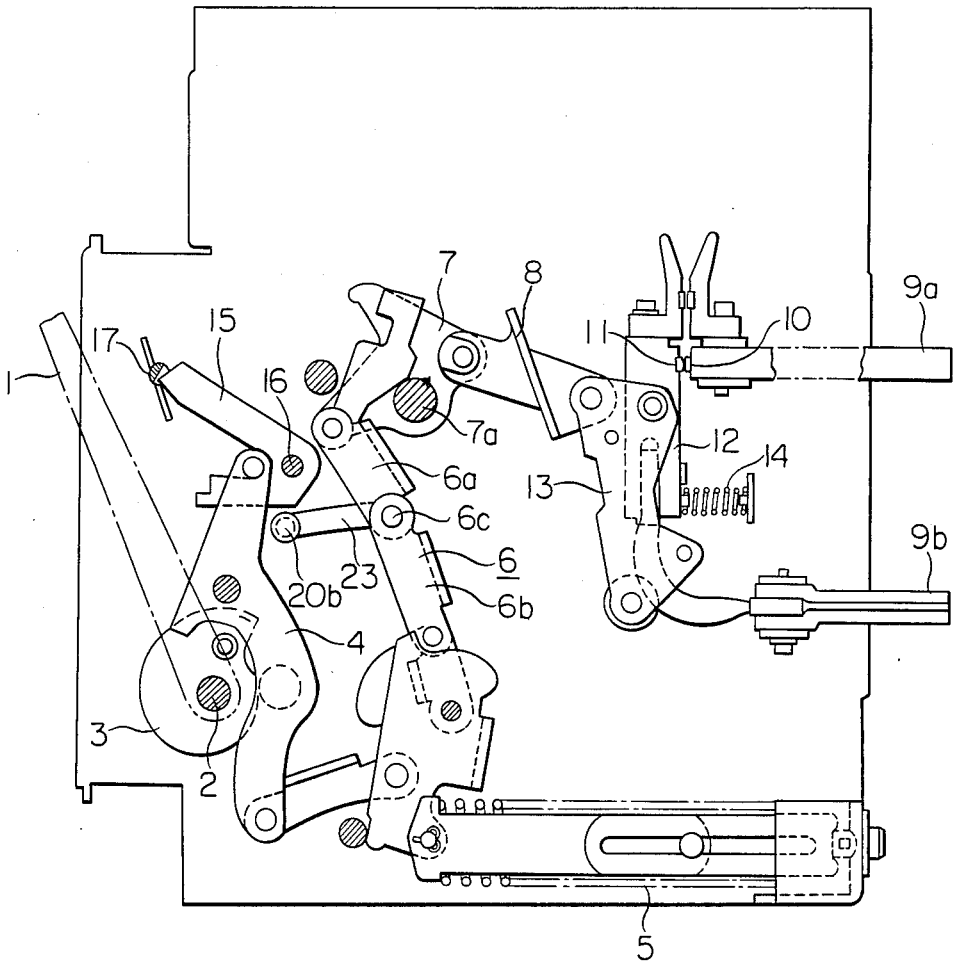
FIG. 1 PRIOR ART
FIG. 1 is a view showing the contact operating mechanism of the conventional device.
Figure 2:
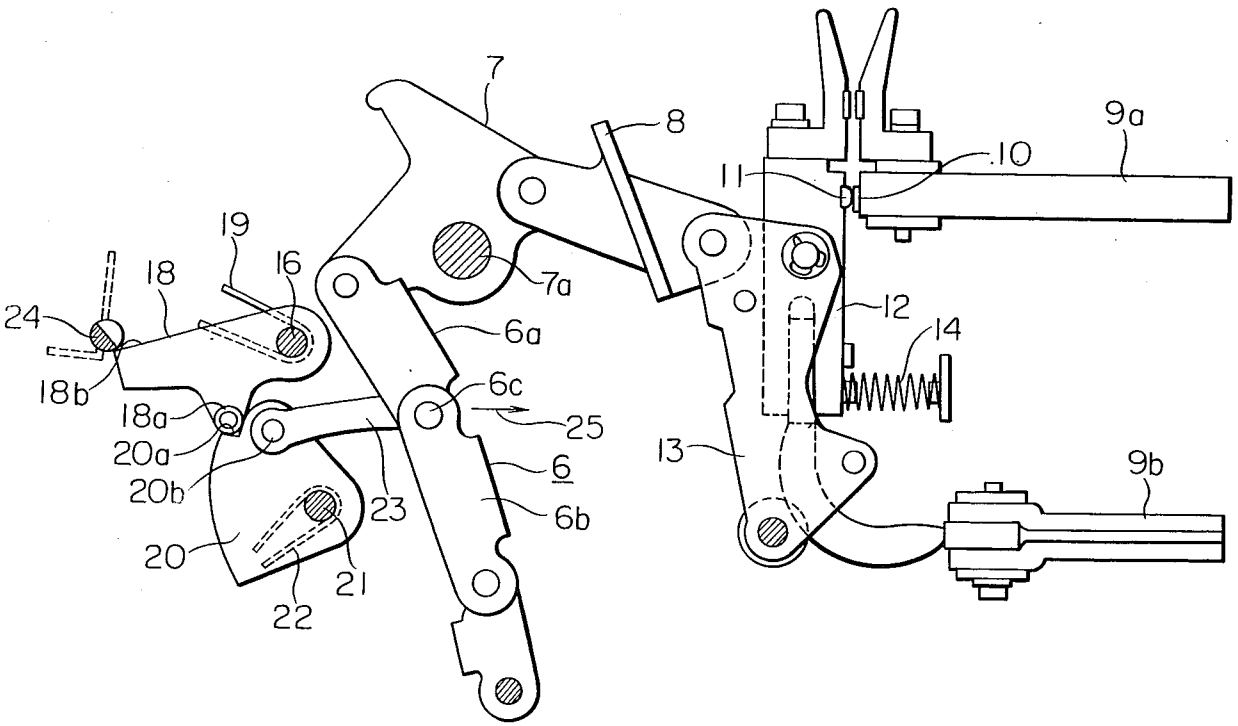
FIG. 2 PRIOR ART
FIG. 2 is a view similar to FIG. 1 showing the state in which the contacts are closed.

FIGS. 4 to 8 illustrate one embodiment of the present invention, in which 26 is a trip latch which is comprised of a roller side latch half 26A having an engaging roller **26*a* and an engaging latch half 26B having an engaging portion 26*b*. These latch halves 26A and 26B are pivotally mounted on the pivot shaft 16. 27 is a compression spring inserted between the latch halves 26A and 26B, one end of which is fitted over the projection 26C of the roller side latch half 26A and the other end of which is fitted on the adjusting screw 28 of the engaging side latch half 26B. A nut 29 is for forwarding and retracting the adjusting screw 28 to adjust the compressive force of the spring 27. An arm portion 30 is integrally mounted on the roller side latch half 26A for restricting the opening of the engaging side latch half 26B**. The remaining construction is the same as that in the conventional design, so that the same reference characters and their explanation will be omitted.

The operation will now be described. In the state shown in FIG. 4, the direction changing lever 7 is biased to rotate counterclockwise by the tension of the contact pressure spring 14 and the link mechanism 6 is subjected to a force which tends to collapse at the pin **6*c* in the direction of the arrow 25. However, since the second cam 20 does not rotate clockwise because it is blocked by the trip latch 26, the illustrated state is maintained. In this state, the compression spring 27 is not contracted by the action of the contact pressure spring 14, so that the latch halves 26A and 26B** are not displaced and the trip latch is not moved. Therefore, the normal interrupting operation is not at all influenced.

Figure 3:
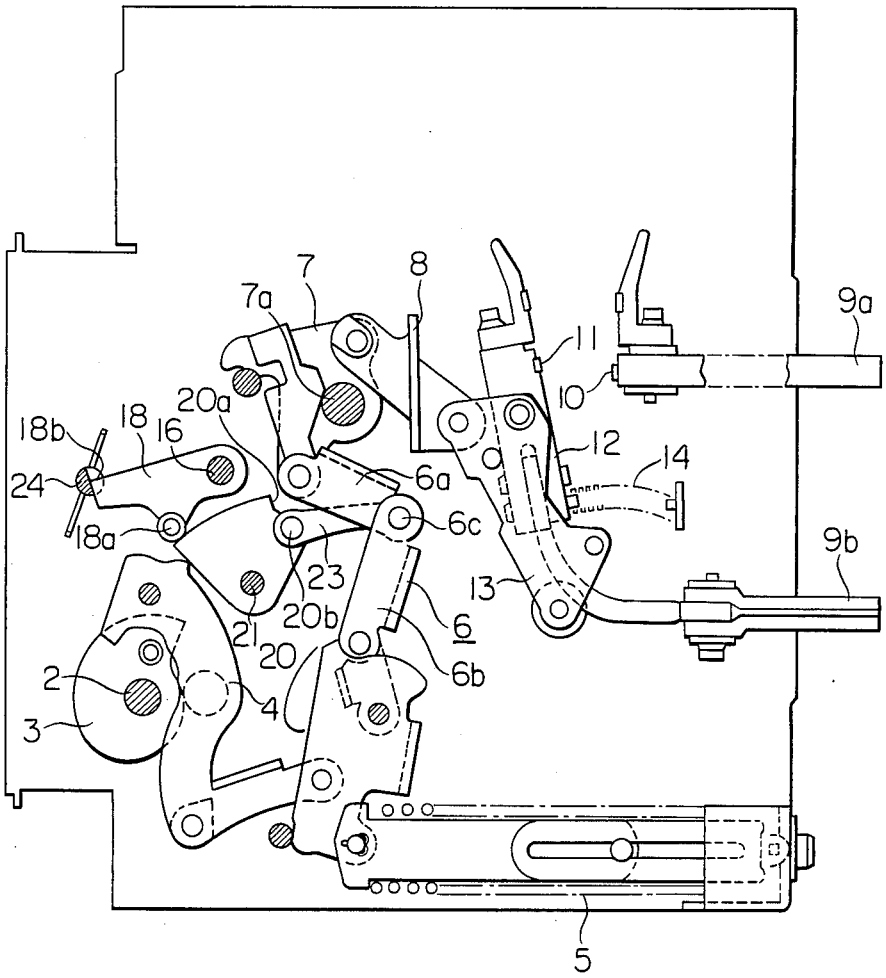
FIG. 3 PRIOR ART
FIG. 3 is a view showing the state in which the contacts are opened.
Figure 4:
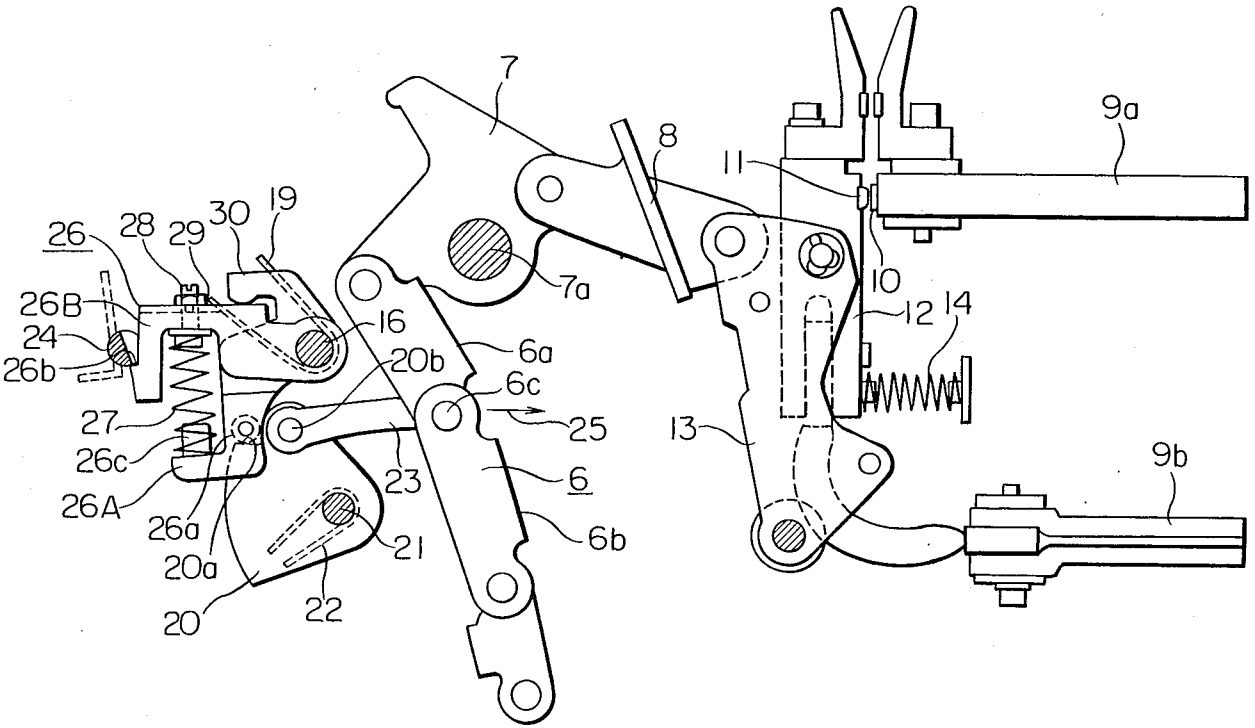
FIG. 4 is a view showing the contact operating mechanism of one embodiment of the present invention.
Figure 5:
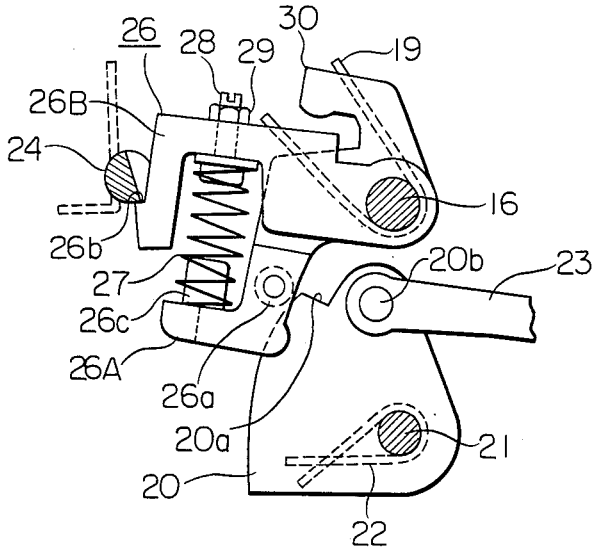
FIG. 5 is a partial enlarged view showing the contact opening waiting state shown in FIG. 4 at the moment it is released.
Figure 6:
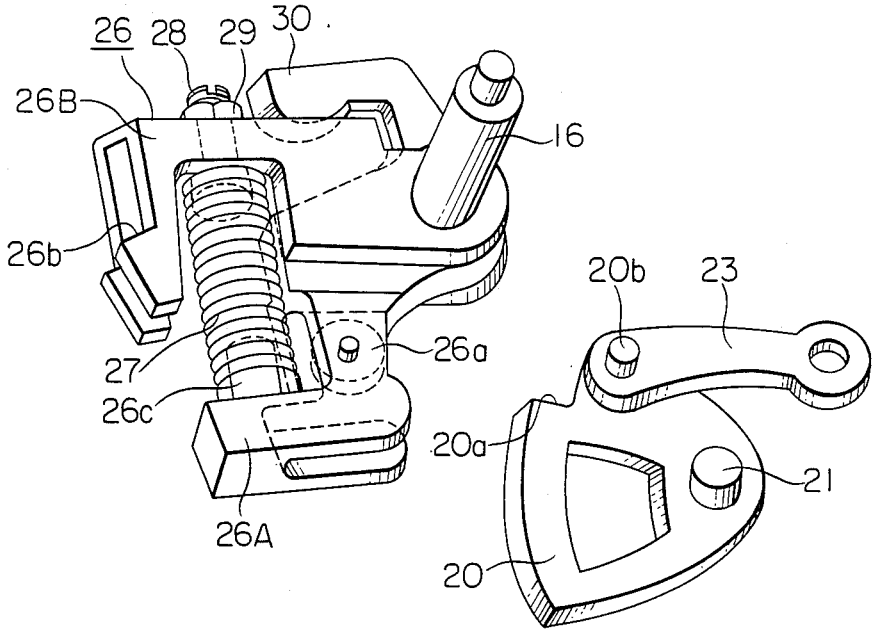
FIG. 6 is an exploded perspective view of FIG. 5.
Figure 7:
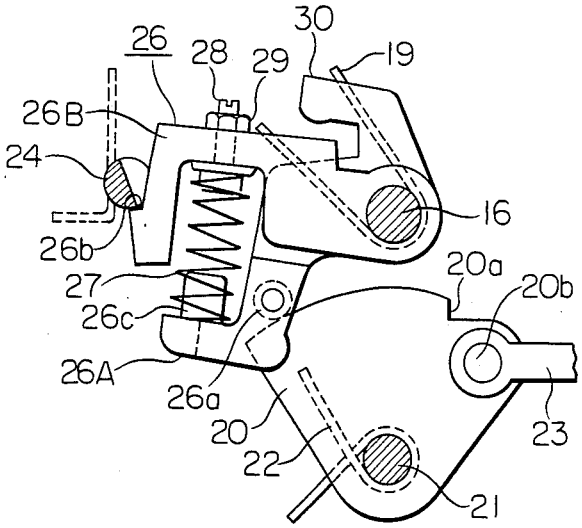
FIG. 7 is a view of the contact opening state similar to FIG. 5.
Figure 8:
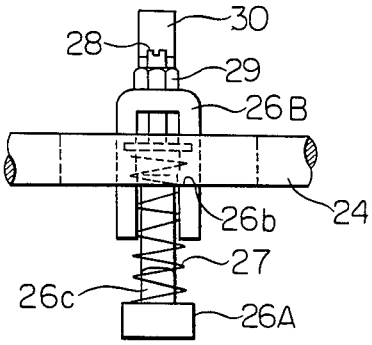
FIG. 8 is a view of the trip latch as viewed from the left in FIG. 7.

When a current exceeding the predetermined value flows when the contacts are closed, a repulsive force is generated between the contacting points of the contacts 10 and 11.

$$\text{Repulsive Force} = [\mu i^2/4]\log[eA/a]$$

where,

A: radius of the contact a: radius of the contacting surface $\mu$: magnetic permeability of the contact i: current The contact repulsive force acts on the strut link 23 through the direction changing lever 7 and the link mechanism 6 to apply, together with the contact pressure spring 14, a clockwise rotating force to the second cam 20. This rotating force is transmitted to the roller side latch half 26A through the engaging roller *26a*, and when the rotating force exceeds the spring force of the compression spring 27, the roller side latch half 26A is pushed up as shown in FIG. 5 to rotate the latch halves 26A and 26B, so that the engaging roller *26a* disengages from the recessed portion *20a* of the second cam 20, and the second cam 20 is rotated clockwise to be positioned in the state shown in FIG. 7. This state shown in FIG. 7 is the state in which the contacts 10 and 11 are separated as in the state shown in FIG. 3.

While the elastic member is explained as being a compression spring 27 in the above embodiment, a similar effect can be obtained with an elastic rubber or the like.

As has been described, the present invention is advantageous in that the interrupting capacity can be increased without increasing the rated interrupting current and the frame size by shortening the interrupting time.

What is claimed is:

1. An air circuit interrupter comprising;

a first cam driven to be rotated by the handle operation of the circuit interrupter;

a charge lever in rolling contact with said first cam for rotation;

an energy storing spring chargeable by said charge lever;

a link mechanism for transmitting the stored spring force in said spring to the side of a contact operating mechanism;

a contact-opening-waiting mechanism for preventing said link mechanism from driving said contact operating mechanism to open when the contact is closed by an action of a spring force of a contacting pressure spring in said contact operating mechanism and an electromagnetic repulsive force acting on a current carrying member due to a current above a predetermined value;

and an OFF operating member for opening the contact by releasing the contact-opening-waiting state by said contact-opening-waiting mechanism;

said contact-opening-waiting mechanism comprising a second cam connected to said link mechanism and a trip latch having an engaging roller for engaging said second cam and an engaging portion for engaging said OFF operating member, said trip latch comprising a roller side latch half member having said engaging roller, an engaging side latch half member having said engaging portion, said half members being pivotally mounted on a common shaft, and an elastic member inserted between said half members so that they are biased away from each other, said half members of said trip latch being displaced toward each other against said elastic member by said action to release said contact-opening-waiting state to open the contact.

2. An air circuit interrupter as claimed in claim 1, wherein said elastic member comprises a compression spring.

3. An air circuit interrupter having contacts movable between open and closed positions comprising:

an energy storing spring;

means for charging the energy storing spring;

a contact operating mechanism operatively associated with the contacts and including a contacting pressure spring;

a link mechanism connected between the contact operating mechanism and the energy storing spring and movable between an extended position with the contacts closed and a folded position with the contacts open; and means responsive to a contact current exceeding a predetermined value for releasing the link mechanism to the folded position, the means for releasing the link mechanism including a trip latch having first and second latch members pivotally mounted to each other and an elastic member inserted between them, the elastic member being responsive to the spring force of the contacting pressure spring and the electromagnetic force acting on the contacts.

4. The air circuit interrupter of claim 3 wherein the releasing means further includes a cam connected to the link mechanism and having a recessed portion and the first latch member includes a roller engageable with the recessed portion of the cam when the link mechanism is in the extended position.

5. The air circuit interrupter of claim 4 wherein the elastic member comprises a spring.

6. The air circuit interrupter of claim 5 wherein the releasing means further includes means for adjusting the force of the spring.

* * * * *